US007168577B1

(12) United States Patent
Moseley

(10) Patent No.: US 7,168,577 B1
(45) Date of Patent: Jan. 30, 2007

(54) CAP STORAGE AND DISPLAY ASSEMBLY

(76) Inventor: Randall C. Moseley, 26080 Mulholland, Calabasas, CA (US) 91302

( * ) Notice: Subject to any disclaimer, the term of this patent is extended or adjusted under 35 U.S.C. 154(b) by 223 days.

(21) Appl. No.: 10/896,423

(22) Filed: Jul. 22, 2004

(51) Int. Cl.
*A47F 7/06* (2006.01)

(52) U.S. Cl. ..... 211/32

(58) Field of Classification Search ..... 211/30–32, 211/89.01, 105.1, 105.2, 182, 183; 411/508–510, 411/913; 206/8, 9, 278; D6/315, 320, 328; 223/7, 12, 24, 66, 25, 120; 248/181.1, 215, 248/181.2, 214, 288.31, 304; 24/453, 297, 24/457, 458; 403/326, 329, 330, 122, 56, 403/76, 129, 128, 364, 375, 311, 298
See application file for complete search history.

(56) References Cited

U.S. PATENT DOCUMENTS

| | | | | | |
|---|---|---|---|---|---|
| 252,925 | A * | 1/1882 | Browning | 211/33 |
| 571,772 | A * | 11/1896 | Leger | 211/33 |
| 621,023 | A * | 3/1899 | Boas | 211/33 |
| 1,124,714 | A * | 1/1915 | Denning | 211/33 |
| 1,231,635 | A * | 7/1917 | Nelson | 211/33 |
| 1,390,372 | A * | 9/1921 | Miller | 211/32 |
| 1,698,633 | A * | 1/1929 | Agustin | 223/24 |
| 2,291,877 | A * | 8/1942 | Carter et al. | 211/33 |
| 3,198,408 | A * | 8/1965 | Benner | 223/66 |
| 3,307,857 | A * | 3/1967 | Robertson | 280/511 |
| 3,464,603 | A * | 9/1969 | Hunter | 223/66 |
| 3,515,318 | A * | 6/1970 | Preble | 223/66 |
| 3,539,234 | A * | 11/1970 | Rapata | 384/203 |
| 3,740,013 | A * | 6/1973 | Bentley et al. | 223/66 |
| 4,757,905 | A * | 7/1988 | Green | 211/31 |
| 6,112,909 | A * | 9/2000 | Moseley | 211/32 |
| 6,113,301 | A * | 9/2000 | Burton | 403/122 |
| 2005/0191119 | A1 * | 9/2005 | Aoshima et al. | 403/122 |

* cited by examiner

*Primary Examiner*—Jennifer E. Novosad
(74) *Attorney, Agent, or Firm*—Albert O. Cota

(57) ABSTRACT

A cap storage and display assembly (10) that is comprised of three elements: a cap support (12), a swivel arm (32), and a mounting plate (70). The cap support (12) is dimensioned to accept a cap (90) preferably consisting of a sport cap (90). The cap (12) has on a lower surface (16) a segmented receptacle (20) that is rotatably attached to a segmented ball plug (42) located on an outer end (34) of the swivel arm (32). The inner end of the swivel arm (32) has a segmented button plug (54) that is rotatably attached to a serrated bore (82) located on the mounting plate (70). The plate (70) also has a bolt mounting bore (78) that accepts a bolt that secures the plate (70) to a mounting surface (92). When the assembly (10) is secured, the cap support (12) can be tilted and radially rotated, and the swivel arm (32) can also be radially rotated to allow the assembly (10) to be positioned in an optimum cap (90) display position.

10 Claims, 4 Drawing Sheets

CAP STORAGE AND DISPLAY ASSEMBLY

TECHNICAL FIELD

The invention pertains to the general field of cap and hat storage and display assemblies and more particularly to an integrated cap storage and display assembly that is attached to a vertical or a horizontal surface.

BACKGROUND ART

One of the most popular and constantly growing activities of both young and elderly people is the collecting of sports memorabilia. This hobby, as it is popularity referred to, includes not only the collecting of trading cards, but also such items as balls, jerseys and, especially baseball caps. Although baseball caps are usually associated with baseball, most major sports now also utilize these types of caps. It is just as common to see a cap emblazoned with the logo of the Los Angeles Dodgers baseball team, as it is the Dallas Cowboys football team.

As a result of the popularity of baseball caps, a team, a club or a business establishment can receive significant free publicity from people wearing their cap. Therefore, a great deal of time and energy is dedicated to making quality, multi-colored, high-graphic designs on the caps. This has led to a pronounced collectability of baseball caps. In addition to caps with almost every major sports team, there are also caps that commemorate special events such as the World Series or Superbowl. Also, many companies, from large multi-national conglomerates to small retail stores, have discovered the use of baseball caps to display their name, logo, a message or other indicia.

One of the problems that affects baseball cap collectors is how to display their collection. Due to the flexible design of most baseball caps it is difficult to maintain them in the same position as when they are worn. If a viewer is unable to see the indicia on the cap, the whole purpose of collecting and displaying the caps is defeated. The solution is to provide a display means that is especially designed to accept the hemispheric shape of a baseball cap. A display means such as this would allow a collector, and also non-collectors and retail stores, to easily and correctly place a baseball cap in a position that ensures the cap and any indicia will be completely visible.

A search of the prior art did not disclose any literature or patents that read directly on the claims of the instant invention. However, the following U.S. patents are considered related:

| U.S. PAT. NO. | INVENTOR | ISSUED |
|---|---|---|
| 6,112,909 | Moseley | Sep. 5, 2000 |
| 5,480,073 | LaManna | Jan. 2, 1996 |
| 2,034,924 | Simon | Mar. 24, 1936 |
| 503,949 | Crouch | Aug. 29, 1893 |

The U.S. Pat. No. 6,112,909 patent discloses a rack for storing and displaying a plurality of caps such as sport caps. The rack consists of three elements: a base, a cap support and a base/cap support attachment rod. The base can be attached to a substantially flat surface in either a vertical or a horizontal orientation and preferably has a length to accommodate six sport caps. The cap support has a hemispheric shape that is dimensioned to securely hold and display the cap(s). The base/cap support attachment rod includes a base end and a cap end. The base end terminates with a structure that allows the base end to be attached and secured to the base in either a vertical or a horizontal orientation. The cap end is dimensioned to be attached and secured to the cap support.

The U.S. Pat. No. 5,480,073 patent discloses a cap holder having a base assembly that is attached to a support surface. A plurality of clamp members project from the top surface of the base assembly and each clamp member includes a round contour that is adapted to contact a round contour on a cap. The clamp members are arrayed on the base assembly such that free ends of the clamp members are parallel to each other. Fasteners are provided for attaching the base assembly to a support surface. Apertures may be provided in the base assembly to receive screws for attaching the base assembly to a support surface.

The U.S. Pat. No. 2,034,924 patent discloses a hat stand or rack that includes a head section for supporting a hat and a rod for supporting the head section. The head section and rod are connected by a fitting that allows the head section to be arranged in various positions.

The U.S. Pat. No. 503,949 patent discloses a hat or bonnet holder that includes a supporting arm that receives a convex form. The convex form is made of wire and is dimensioned to support the hat or the bonnet.

For background purposes and as indicative of the art to which the invention relates, reference may be made to the following remaining patents found in the search:

| U.S. PAT. NO. | INVENTOR | ISSUED |
|---|---|---|
| 5,566,837 | Lema | Oct. 22, 1996 |
| 5,411,144 | Deupree | May 2, 1995 |
| 5,348,166 | Lema | Sep. 20, 1994 |
| 2,709,004 | Dahlstrom | May 24, 1955 |

DISCLOSURE OF THE INVENTION

A. A cap support having an upper surface and a lower surface, wherefrom the center of the lower surface projects outward a first attaching means, B. A swivel arm having a curved shape with an outer end having a second attaching means, and an inner end having a third attaching means. The second attaching means is rotatably attached to the first attaching means that is located on the cap support, and C. A mounting plate having an outer surface, an inner surface, a fourth attaching means for rotatably receiving the third attaching means located on the swivel arm, and a plate securing means for securing the plate to a mounting surface.

The first attaching means is comprised of a segmented receptacle, the second attaching means is comprised of a segmented ball plug, the third attaching means is comprised of a segmented button plug, and the fourth attaching means is comprised of a serrated bore.

When the cap storage and display assembly is secured to a mounting surface, the cap support, with a cap attached, can be tilted and radially rotated. Likewise, the swivel arm can also be radially rotated. By selectively positioning both the cap support and the swivel arm, an optimum cap display position can be provided.

In the preferred design, the cap support has a truncated hemispheric shape and is molded of a plastic material having a plurality of openings that are arranged to form an aesthetically pleasing pattern. The cap support can also be molded of a material having a solid surface on which can be included various forms of indicia. To add structural integrity to the swivel arm, it is designed to include an outer flat section having an inner surface. From the inner surface extends outward a centered reinforcing tab. Additionally, on each end of the swivel arm is integrally attached a reinforcing gusset. To add structural integrity to the mounting plate, a reinforcing structure is integrally added to the inner surface of the plate that interfaces with the fourth attaching means and the plate securing means. The reinforcing structure consists of a bolt mounting bore that is dimensioned to receive a bolt that secures the plate to the mounting surface.

In view of the above disclosure, the primary object of the invention is to produce a cap storage and display assembly that can accommodate various styles of caps, and especially sport caps, that can be easily positioned in various angles, and that can be easily and securely attached to a vertical or a horizontal surface.

In addition to the primary object of the invention it is also an object of the invention to produce a cap support and display assembly that:

Can be molded in various colors.

Requires no maintenance.

Can be marketed as a premium item.

Can be purchased for use in commercial establishments or for use by individuals.

Is cost effective from both a consumer's and manufacturer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred embodiment for a cap storage and display assembly that attaches preferably to a wall to allow a cap or a hat to be easily and prominently displayed. The preferred embodiment of the cap storage and display assembly 10, as shown in FIGS. 1–9, is comprised of three major elements: a cap support 12, a swivel arm 32, and a mounting plate 70. All the elements comprising the cap storage and display assembly are molded of a plastic preferably consisting of polyvinylchloride (PVC).

Figure 1:
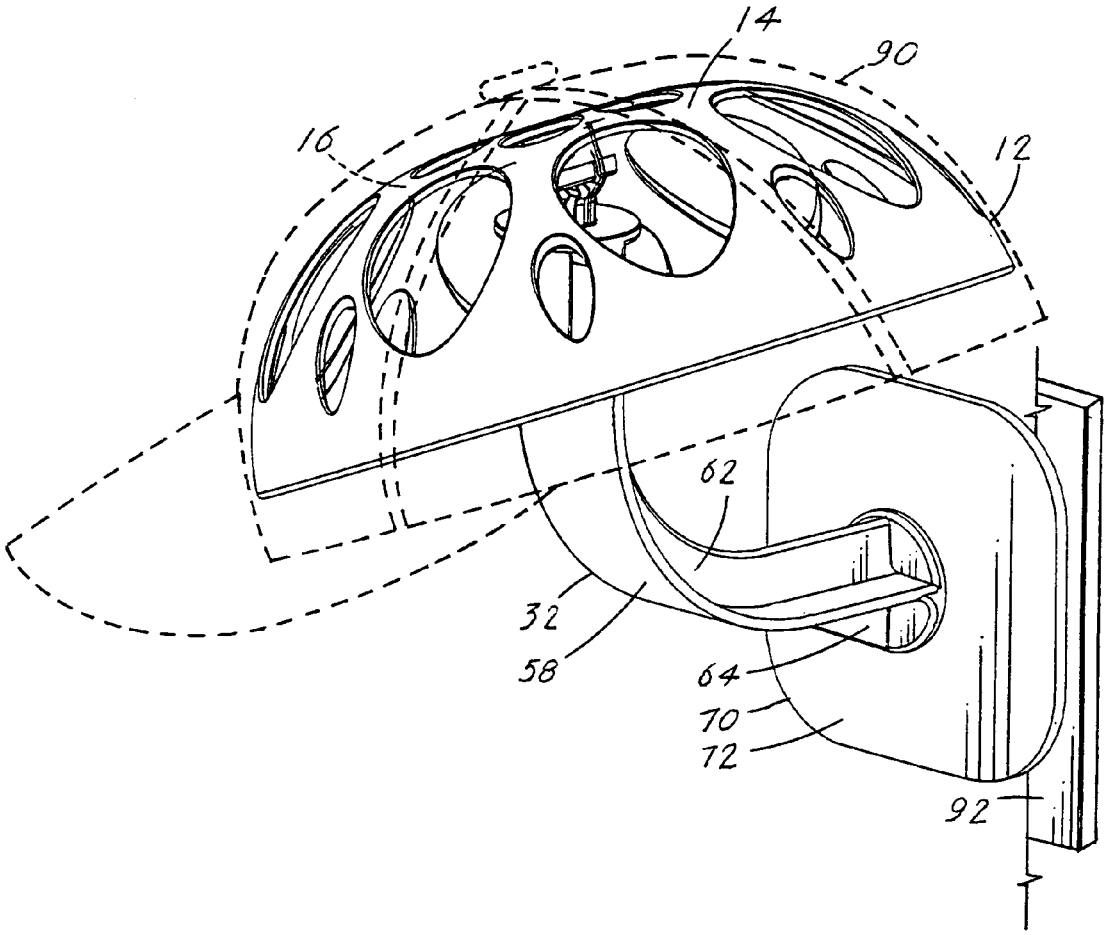
FIG. 1 is a perspective view of a cap storage and display assembly showing in broken lines a sport cap placed upon the assembly.
Figure 2:
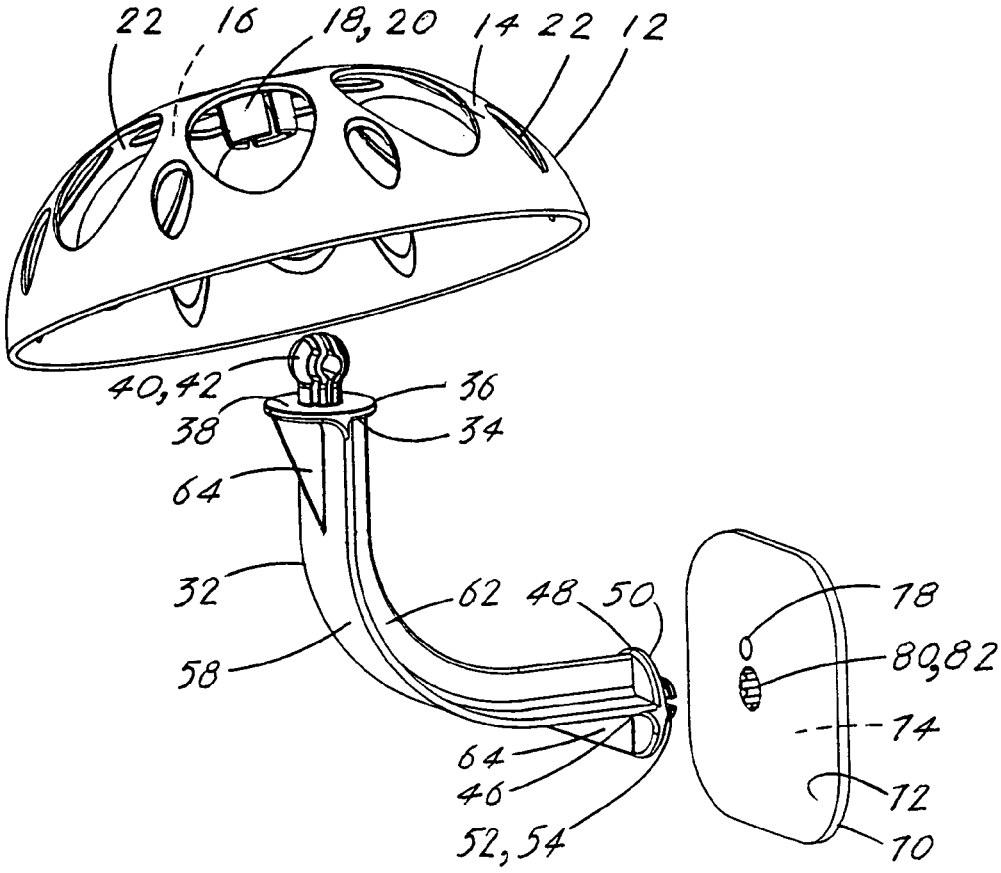
FIG. 2 is an exploded view showing the three elements that comprise the assembly: a cap support, a swivel arm, and a mounting plate.
Figure 3:
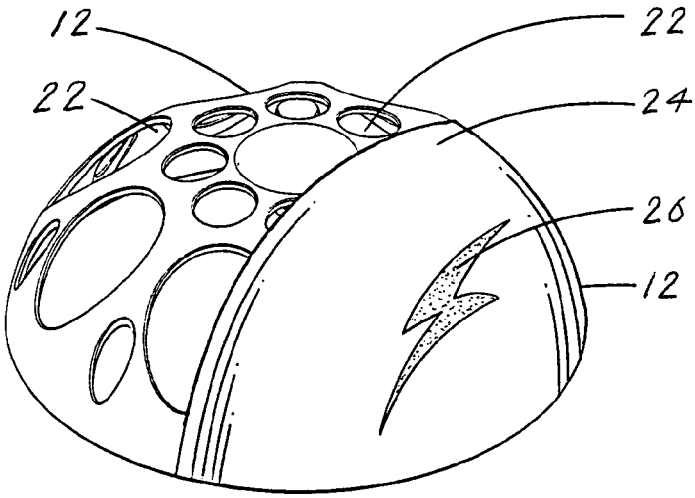
FIG. 3 is an upper perspective view of the cap support showing on the left side a plurality of aesthetically arranged openings, and on the right side a solid surface that includes indicia.
Figure 4:
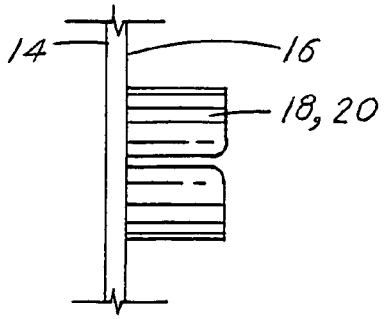
FIG. 4 is a side elevational view of a first attaching means consisting of a segmented receptacle integrally molded to the lower surface of the cap support.
Figure 5:
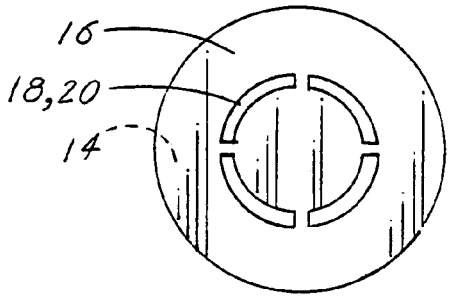
FIG. 5 is front elevational view of the segmented receptacle.

The cap support 12, as shown in FIGS. 1, 2 and 3, is designed to have a truncated hemispheric shape and includes an upper surface 14 and a lower surface 16. From the center of the lower surface 16 projects outward a first attaching means 18 consisting of a segmented receptacle 20 that preferably includes four evenly-spaced segments, as shown in FIGS. 4 and 5. The cap support 12 can be molded to include a plurality of openings 22, as shown in FIGS. 1 and 2, or molded of a solid material 24 that can include indicia 26, as shown on the right side of FIG. 3. Preferably, the cap support 12 is molded with the plurality of openings 22 arranged to form an aesthetically pleasing pattern, as shown best in FIGS. 1 and 2.

Figure 6:
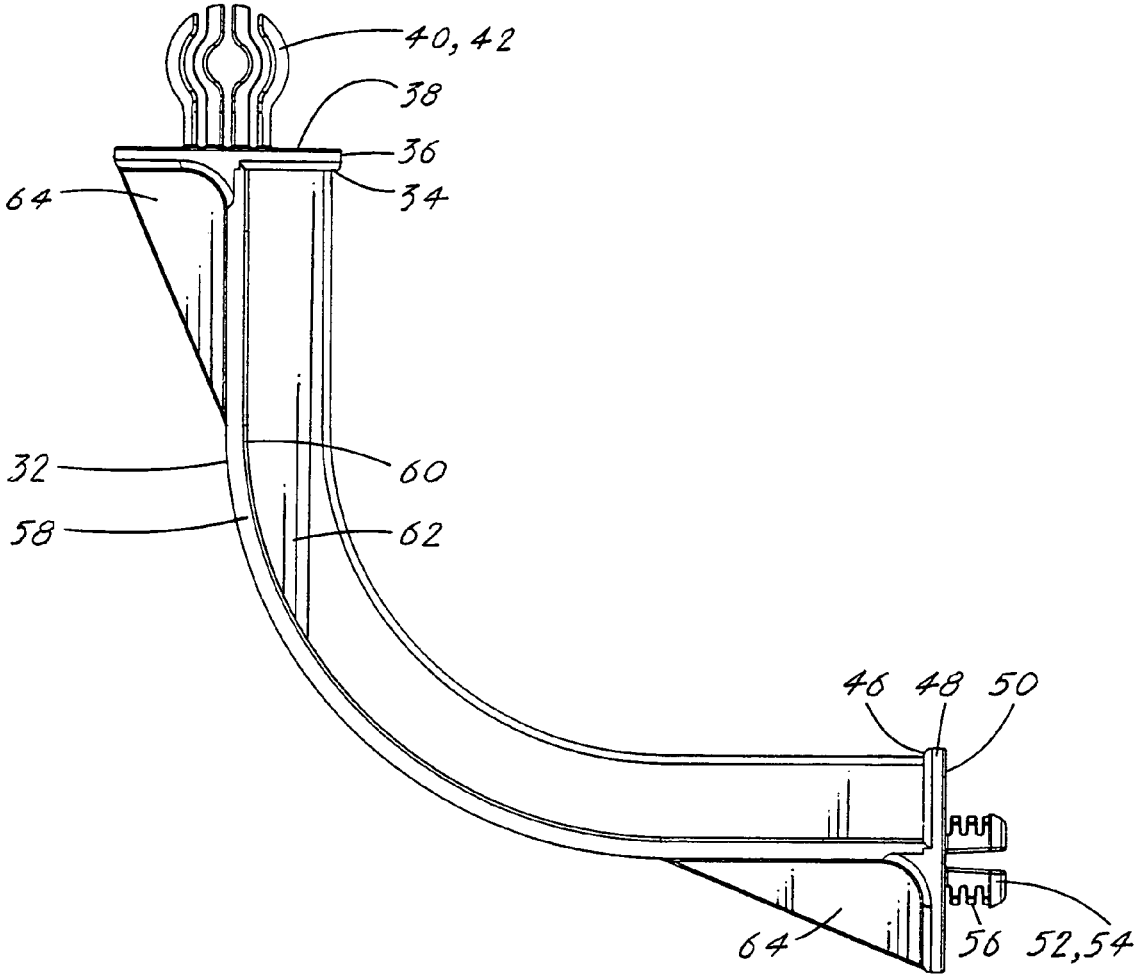
FIG. 6 is a side elevational view of the swivel arm showing a second attaching means consisting of segmented ball plug attached to an outer end, and a third attaching means consisting of a segmented button plug attached to an inner end.
Figure 7:
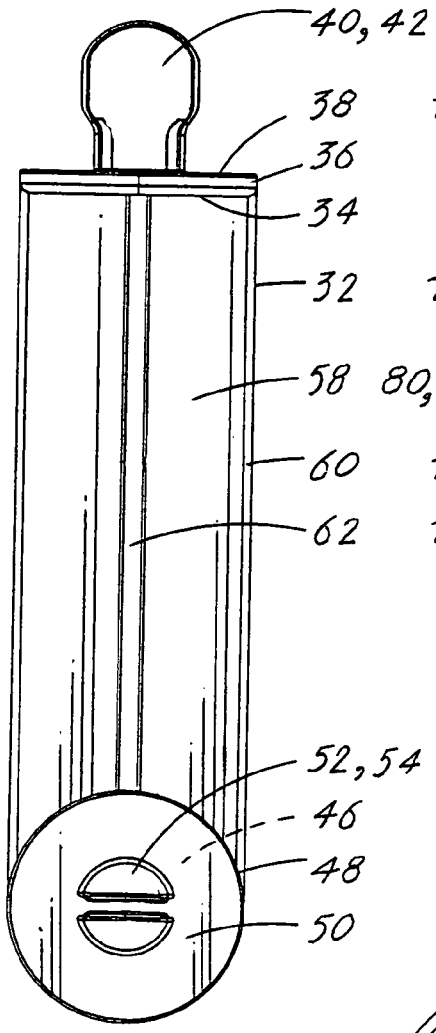
FIG. 7 is a rear elevational view of the swivel arm.

The swivel arm 32, as shown in FIGS. 1, 2, 6 and 7, which is molded to have a substantially 90-degree curved shape, is comprised of an outer end 34 and an inner end 46. The outer end 34 terminates with a circular section 36 having an outer surface 38 from where extends outward a second attaching means 40 consisting of a segmented ball plug 42. The segmented ball plug 42 preferably has four resilient segments, as shown in FIG. 6, and is dimensioned to rotatably fit into the segmented receptacle 20 located on the cap support 12. The inner end 46 terminates in a circular section 48 having an outer surface 50 from where extends outward a third attaching means 52 consisting of a plug that preferably consists of segmented button plug 54 having a plurality of serrated segments 56, as shown in FIG. 6. As shown in FIGS. 6 and 7, the swivel arm 32 in the preferred embodiment, includes an outer flat section 58 having an inner surface 60 wherefrom extends outward and normal a centered reinforcing tab 62. Also, as shown in FIG. 6, a reinforcing gusset 64 is located on each end 34,46 of the swivel arm 32 between the respective circular section 36,48 and the outer flat section 58.

Figure 8:
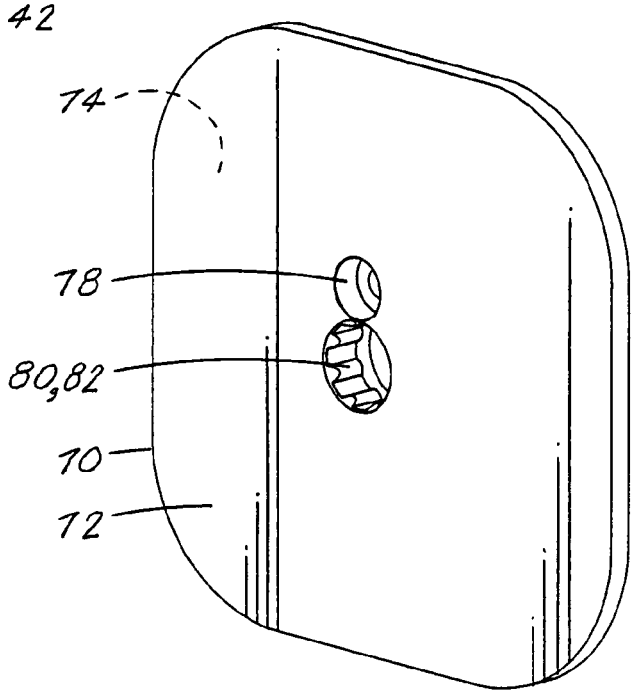
FIG. 8 is a front perspective view of the mounting plate showing the placement of an upper bolt mounting bore relative to a fourth attaching means consisting of a serrated bore.
Figure 9:
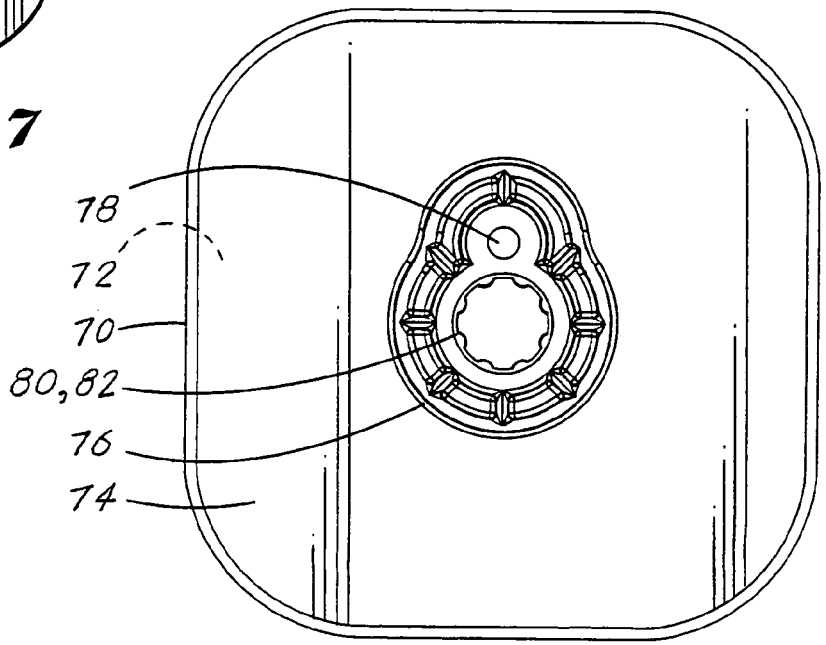
FIG. 9 is a rear elevational view of the mounting plate showing the placement of a reinforcing structure that interfaces with the upper bolt mounting bore and the serrated bore.

The final element that comprises the cap storage and display assembly 10 is the mounting plate 70, as shown in FIGS. 2, 8 and 9. The plate 70 has an outer surface 72 and an inner surface 74. As shown in FIG. 9, an integrally molded reinforcing structure 76 projects outward from the inner surface 74. The mounting plate 70, as best shown in FIG. 8, includes a bolt mounting bore 78 that is dimensioned to receive a bolt (not shown) that secures the plate 70 to a mounting surface 92. As shown in FIG. 1, the circular section 48 on the inner end 46 of the swivel arm 32 is dimensioned to cover the bolt mounting bore 78 when the assembly 10 is attached to the mounting surface 92. Below the bore 78 is located a fourth attaching means 80 that preferably consists of a serrated bore 82 that is dimensioned to rotatably receive the segmented button plug 54 on the swivel arm 32. When the cap storage and display assembly 10 is secured to the mounting surface 92, as shown in FIG. 1, the cap support 12, with a cap 90 attached, can be tilted and radially rotated 360-degrees. The swivel arm 32 can also be radially rotated 180-degrees to provide an optimum cap 90 display position.

Additionally, the mounting plate 70 can be attached to the mounting surface 92 by means of a hook and loop fastener, which would allow the plate 70 to be quickly and easily attached and removed. To add further utility to the design of the cap storage and display assembly 10, a plurality of cap supports 12 and swivel arms 32 can be attached to an enlarged mounting plate 70. In this manner, a person who has several caps 90 can display all of them at once, in a single location.

While the invention has been described in complete detail and pictorially shown in the accompanying drawings it is not to be limited to such details, since many changes and modifications may be made to the invention without departing from the spirit and the scope thereof. Hence, it is described to cover any and all modifications and forms, which may come within the language and scope of the claims.

The invention claimed is:

1. A cap storage and display assembly comprising:

a) a cap support having a truncated hemispheric shape that includes an upper surface and a lower surface, wherefrom the center of the lower surface projects outward a first attaching means, b) a swivel arm having a curved shape with an outer end having a second attaching means, and an inner end having a third attaching means, wherein the second attaching means is rotatably attached to the first attaching means that is located on said cap support, and c) a mounting plate having an outer surface, an inner surface, a fourth attaching means for rotatably receiving the third attaching means located on said swivel arm, and a plate securing means for securing said plate to a mounting surface, wherein when said cap storage and display assembly is secured to the mounting surface, said cap support can be tilted and radially rotated and said swivel arm can also be radially rotated.

2. The assembly as specified in claim 1 wherein:

a) the first attaching means on said cap support is comprised of a segmented receptacle, and b) the fourth attaching means on said mounting plate is comprised of a serrated bore that is dimensioned to rotatably receive a complimentary plug from said swivel arm.

3. The assembly as specified in claim 2 wherein the outer end of said swivel arm terminates in a circular section having an outer surface from where extends outward the second attaching means that is comprised of a segmented ball plug that is dimensioned to rotatably fit into the segmented receptacle on said cap support.

4. The assembly as specified in claim 3 wherein the inner end of said swivel arm terminates in a circular section having an outer surface from where extends outward the third attaching means which is comprised of a segmented and serrated button plug.

5. The assembly as specified in claim 3 wherein the circular section on the inner end of said swivel arm is dimensioned to cover a bolt mounting bore on said mounting plate.

6. A cap storage and display assembly comprising:

a) a cap support having a truncated hemispheric shape with an upper surface and a lower surface, wherefrom the center of the lower surface projects outward a segmented receptacle, b) a swivel arm having a substantially 90-degree curved shape with an outer end and an inner end, wherein the outer end terminates with a circular section having an outer surface from where extends outward a segmented ball plug that is dimensioned to rotatably fit into the segmented receptacle on said cap support, wherein the inner end terminates in a circular section having an outer surface from where extends outward a segmented button plug, and c) a mounting plate having an outer surface and an inner surface, where from the inner surface projects outward a reinforcing structure, said plate having an upper bolt mounting bore that is dimensioned to receive a bolt that secures said plate to a mounting surface, and a lower serrated bore dimensioned to rotatably receive the segmented button plug from said swivel arm, wherein when said cap storage and display assembly is secured to the mounting surface, said cap support, with a cap attached, can be tilted and radially rotated 360-degrees and said swivel arm can also be radially rotated 180-degrees to provide an optimum cap display position.

7. The assembly as specified in claim 6 wherein said cap support further comprises a plurality of openings that are arranged to form an aesthetically pleasing pattern.

8. The assembly as specified in claim 6 wherein said cap support is molded of a solid material on which can include indicia.

9. The assembly as specified in claim 6 wherein said swivel arm is comprised of:

a) an outer flat section having an inner surface wherefrom extends outward and normal a centered reinforcing tab, and c) a reinforcing gusset located on each end of said swivel arm between the respective circular section and the outer flat section.

10. The assembly as specified in claim 6 wherein said assembly is comprised of polyvinylchloride (PVC) plastic.

* * * * *